United States Patent [19]

Brault et al.

[11] Patent Number: 4,919,069

[45] Date of Patent: Apr. 24, 1990

[54] LOGO SPRAY APPARATUS

[75] Inventors: Alfred Brault, Berwick, Me.; Roberto Rosa-Miranda, Dover, N.H.

[73] Assignee: Davidson Textron Inc., Dover, N.H.

[21] Appl. No.: 245,212

[22] Filed: Sep. 16, 1988

[51] Int. Cl.[5] ..... B05C 1/02; B24C 41/08

[52] U.S. Cl. ..... 118/308; 118/315; 118/323; 425/103

[58] Field of Search ..... 118/317, 308, 313, 315, 118/316, 323

[56] References Cited

U.S. PATENT DOCUMENTS

| | | | |
|---|---|---|---|
| 2,215,668 | 9/1940 | Smith | 118/323 |
| 2,751,879 | 6/1956 | Holtzman | 118/326 |
| 2,846,973 | 8/1958 | Callaghan | 118/326 |
| 2,888,903 | 6/1959 | Faber | 118/316 |
| 3,083,133 | 3/1963 | Hansen et al. | 264/309 |
| 3,346,412 | 10/1967 | Siegenthaler et al. | 118/326 |
| 3,633,651 | 1/1972 | Ruhlandt | 425/103 |
| 3,880,112 | 4/1975 | Spitz et al. | 118/323 |
| 3,899,994 | 8/1975 | Cook et al. | 118/6 |
| 3,903,715 | 9/1975 | Plötz | 118/323 |

*Primary Examiner*—Willard Hoag

*Attorney, Agent, or Firm*—John C. Evans

[57] ABSTRACT

An apparatus for depositing a layer of thermoplastic material onto a surface bearing a recessed logo or other decorative design of a logo plaque mold, wherein the apparatus includes a cylindrical housing enclosing a rotatable shaft and spray gun extension. The rotatable shaft may be operatively connected to the housing for rotation along the centerline thereof, and the spray gun extension in secured to a side of the shaft such that the axis of the extension is parallel to the axis of the shaft so as to be rotated concentrically with the shaft when the latter is rotated. Thus, a suitable thermoplastic material is deposited on the recessed logo or design of an associated mold surface, providing for the retention of segments in the recesses for being bonded onto a subsequent base layer of thermoplastic material.

4 Claims, 2 Drawing Sheets

LOGO SPRAY APPARATUS

TECHNICAL FIELD

This invention relates generally to apparatus for spraying thermoplastic material onto a surface of a recessed logo plaque mold and, more particularly, to a rotatable powder spray gun arrangement therefor.

BACKGROUND ART

Heretofore, a layer of powdered thermoplastic material has typically been applied by turning a casting box containing suitable powdered material upside down while mounted in a sealed condition on a recessed logo plaque mold, to thereby deposit the powder on the mold surface. Such an arrangement is shown and described in U.S. patent application, Ser. No. 074,354, filed on July 16, 1987.

Spray guns have been used to apply coatings to various surfaces, e.g., Hansen et al U.S. Pat. No. 3,083,133 shows the broad idea of using a spray nozzle to spray a liquid plastisol material onto a panel.

Cook et al U.S. Pat. No. 3,899,994 discloses a spray applicator having two spray nozzles confined within a shroud which is vertically movable.

Holtzman U.S. Pat. No. 2,751,879 illustrates and describes upper and lower spray stations, each including a water spray nozzle within a hood.

O'Callaghan U.S. Pat. No. 2,846,973 and Siegenthaler et al U.S. Pat. No. 3,346,412 each disclose rotatable nozzle arrangements. O'Callaghan includes rotatable conduitry having a nozzle with an offset or angularly disposed end portion for applying an organic film to the interior surface of cathode-ray tubes. Siegenthaler et al discloses a tire interior coating apparatus including a rotatable and vertically moveable dispensing assembly having a substantially conically oriented discharge nozzle assembly.

DISCLOSURE OF THE INVENTION

A general object of the invention is to provide an improved spray gun apparatus for spraying a suitable thermoplastic material onto a surface of a mold tool having recesses defining a logo or other decorative design formed in the surface.

Another object of the invention is to provide an improved rotary powder spray gun apparatus for such a mold tool.

A further object of the invention is to provide a spray gun apparatus for a logo mold tool, including a cylinder adapted to being sealably mounted around the recessed logo or other decorative design formed in a mold surface, a rotating shaft operatively connected to, and axially aligned within the cylinder, and a spray gun extension secured to a side of the shaft for rotation therewith, to apply a suitable thermoplastic powder in a circular path to the entire mold surface within the cylinder.

These and other objects and advantages of the invention will be more apparent when reference is made to the following drawings and the related description.

BEST MODE OF CARRYING OUT THE INVENTION

Figure 1:
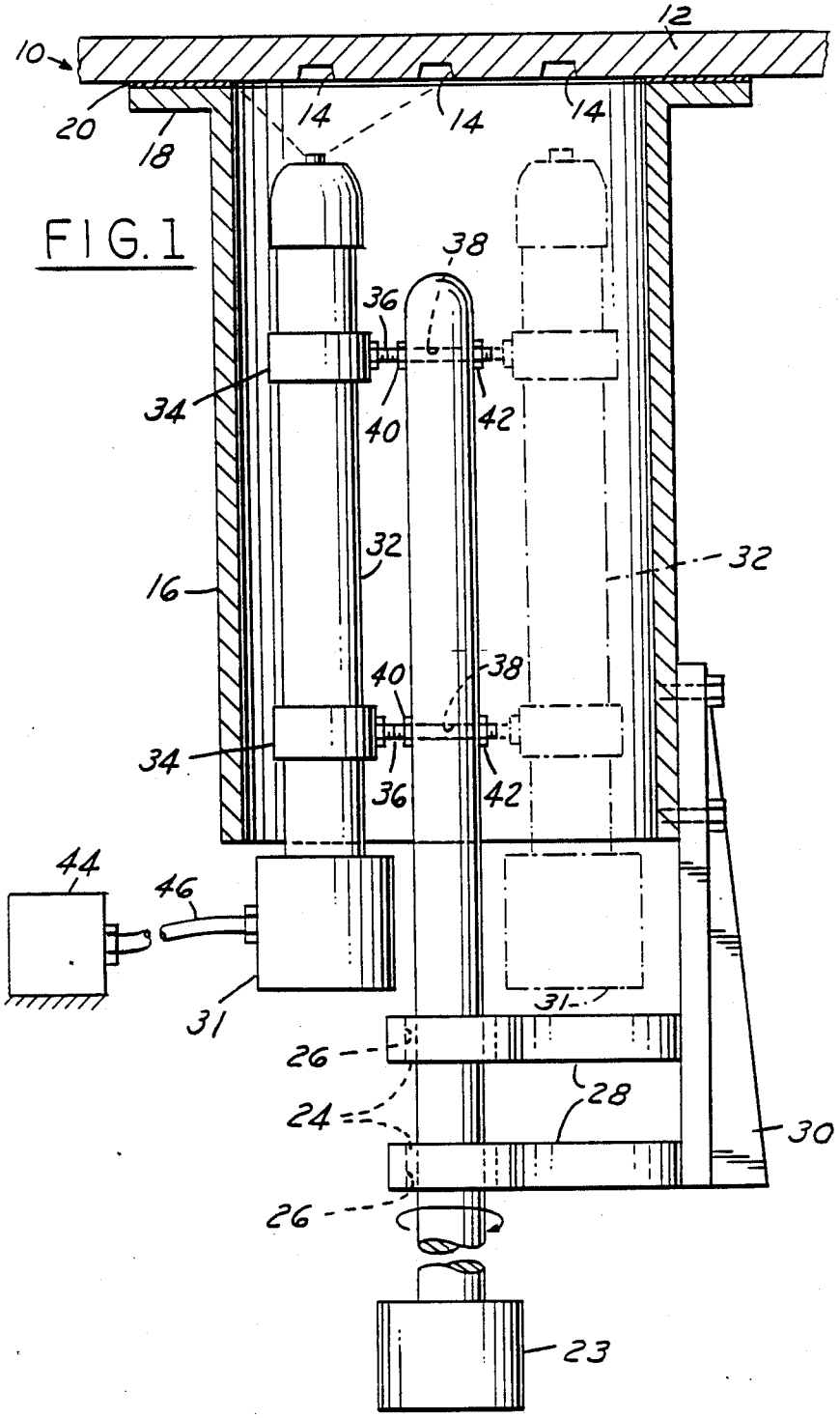
FIG. 1 is a side elevational view, in partial cross-section, of the invention applied to a logo mold tool.
Figure 2:
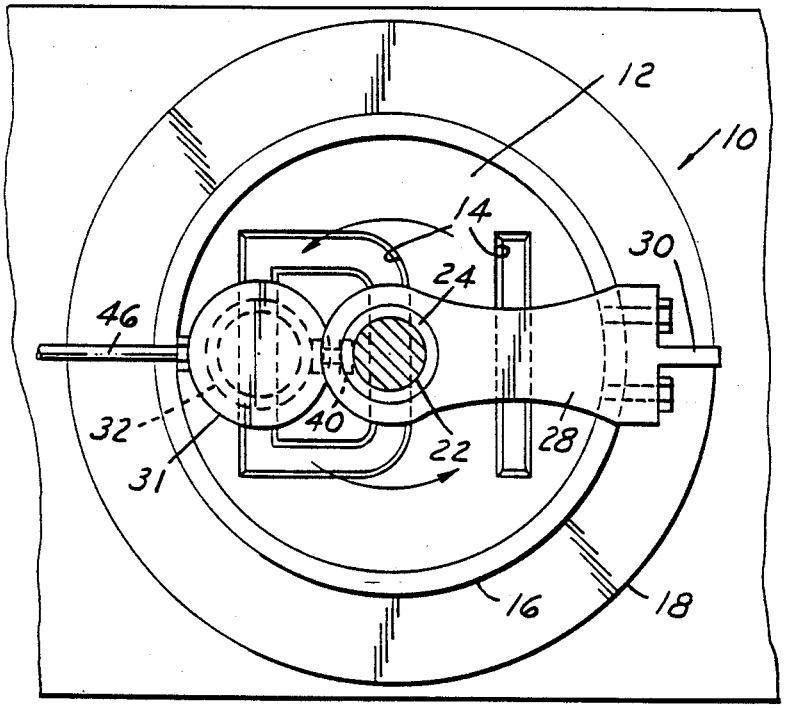
FIG. 2 is a top view of the FIG. 1 structure, taken along the plane of the line 2—2, and looking in the direction of the arrows.

Referring now to the drawings in greater detail, FIG. 1 illustrates a logo spray apparatus 10 including a mold tool or logo plaque mold 12 having recesses 14 formed therein which define any desired logo or other contrasting trim feature, such as the logo, stitch and/or pin stripe shown and described in U.S. patent application, Ser. No. 074,354, and incorporated herein by reference.

A cylindrical housing 16 having an external flange 18 formed on one end thereof, with a suitable seal 20 operatively connected to the outer surface of the flange, is pressed against the logo plaque mold 12, confining a predetermined area around the recesses 14.

A rotatable shaft 22, actuated by any suitable remote means, represented at 23, is mounted along the centerline of the cylindrical housing 16. The shaft 22 may be rotatably mounted through suitable bushings or bearings 24 mounted in openings 26 formed in brackets 28 secured by any suitable mounting means 30 to the end of the cylindrical housing 16 opposite the flange 18 end.

A suitable spray gun, represented at 31, is detachably secured to a powder spray gun extension 32, which extends through and is secured within spaced apart clamps 34, such that the end of the extension 32 is a predetermined distance from the flanged end face of the housing 16. The clamps 34 are secured to the rotatable shaft 22 in any suitable manner, but may include threaded extensions 36 mounted through lateral openings 38 formed in the shaft. Nuts 40 and 42 threadably mounted on each of the extensions 36 on opposite sides of the rotatable shaft 22 secure the powder spray gun extension 32 relative to the shaft, such that the axis of the spray gun extension is concentric with the axis of the shaft to thereby produce a rotation of the spray gun extension in a circular pattern adjacent the area of the logo plaque mold 12 which is confined by the cylindrical housing 16. A remote source 44 of suitable thermoplastic material supplies such material via a flexible line 46 to the spray gun 31.

Figure 3:
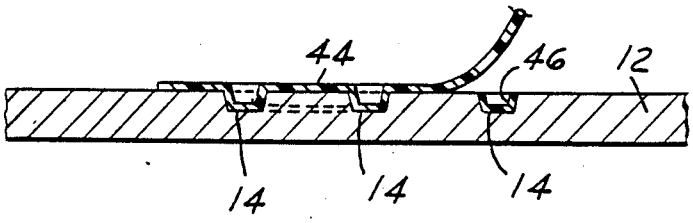
FIG. 3 is an enlarged perspective view sectioned on the line 2—2 of FIG. 1, and looking in the direction of the arrows.

In operation, the logo plaque mold 12 is preheated in the usual manner. The cylinder 16 is then pressed against the mold surface, as shown in FIG. 1, after which the powder spray gun 33 and its extension 32 are rotated by the rotatable shaft 22, and actuated to direct a dispersion of the thermoplastic material as a thin covering or membrane 44 (FIG. 3) over the mold 12 surface and in the logo recesses 14. It should be noted that generally a single revolution of the spray gun extension 32 from one side of the brackets 28 to the other side thereof is sufficient to cover the mold surface with a suitable covering 48. If necessary, additional reciprocal partial revolution of the extension 32 may be made to adequately cover the mold surface. The flexible line 46 is of a length sufficient to permit a partial wind-up thereof during the reciprocal movement of the spray gun 31.

The cylindrical housing 16 and powder spray gun 32 are then removed from the logo plaque mold 12. After cooling, the thus formed membrane on the mold 12 surface is then stripped from the mold surface, breaking away from and leaving trapped segments 50 in the recesses 14 in the conventional manner.

Typically, the logo plaque mold 12 is heated once again, after which the cylindrical housing 16 and its associated powder spray gun 33 and extension 32 are again pressed in place around the recesses 14 area. The latter area is covered with a second layer of suitable thermoplastic material, to thereby fill in the recesses 14 and optionally, provide a contrasting color for the layer covering the logo or other predetermined decorative feature, when the second membrane layer is stripped from the mold 12 surface, the previously trapped segments in the recesses 14 will have become bonded to the new layer of material by virtue of reheating the mold, and cooling and stripping same to form the typical finished plastic shell having the logo or other decorative feature formed thereon.

The technique just described involves the same casting sequence as that described in the above referenced application Ser. No. 074,354, the inventive difference being the use of the above described cylinder 16 and associated rotating shaft 22 and powder spray gun 33 and extension 32, rather than the powder casting box or liquid plastisol spray apparatus shown and described in Ser. No. 074,354.

INDUSTRIAL APPLICABILITY

It should be apparent that the invention provides a novel means of applying a deposit of suitable thermoplastic material on a selected area of a mold tool around a logo or other decorative design.

It should also be apparent that the cylindrical housing and associated rotating shaft and powder spray gun and extension can be packaged as an integral unit, readily adaptable to being manually applied to a mold tool or logo plaque mold.

While but one embodiment of the invention has been shown and described, other modifications thereof are possible within the scope of the following claims.

The embodiments of the invention in which an exclusive property or privilege is claimed are defined as follows:

1. A spray apparatus for depositing a layer of thermoplastic material onto a recessed surface of a logo plaque mold, said spray apparatus comprising a housing, seal means secured to an end of said housing, for sealing abutment against the mold surface, a rotatable shaft operatively connected to said housing so as to be rotatably mounted along the centerline thereof, a spray gun extension, and connector means for securing said spray gun extension to a side of said rotatable shaft for rotation therewith such that the axis of the spray gun extension is parallel to the axis of the shaft for depositing the layer of thermoplastic material onto the mold surface in a circular path within said housing.

2. The spray apparatus described in claim 1, wherein said housing is cylindrical in shape.

3. The spray apparatus described in claim 2, wherein said rotatable shaft and said spray gun extension are integrally packaged in said cylindrical housing.

4. The spray apparatus described in claim 1, and a remote source of thermoplastic material, a spray gun extension, and a flexible line communicating between said spray gun and said source.

* * * * *